US009278439B1

(12) United States Patent
Krause

(10) Patent No.: US 9,278,439 B1
(45) Date of Patent: Mar. 8, 2016

(54) VALVE CORE GRIPPER DEVICE

(76) Inventor: Evan J. Krause, Plainfield, IL (US)

( * ) Notice: Subject to any disclaimer, the term of this patent is extended or adjusted under 35 U.S.C. 154(b) by 968 days.

(21) Appl. No.: 13/506,058

(22) Filed: Mar. 23, 2012

(51) Int. Cl.
*B25B 27/02* (2006.01)
*B25B 27/24* (2006.01)

(52) U.S. Cl.
CPC ..... *B25B 27/02* (2013.01); *B25B 27/24* (2013.01); *B25B 27/023* (2013.01); *B25B 27/026* (2013.01)

(58) Field of Classification Search
CPC ..... B23P 19/045; B25B 13/48; B25B 27/24; B25B 27/0028; B25B 27/023; B25B 27/02; B25B 27/26; B25B 7/18
USPC ..... 29/214, 221.6, 244–28, 213.1, 221.52
See application file for complete search history.

(56) References Cited

U.S. PATENT DOCUMENTS

| | | | | |
|---|---|---|---|---|
| 1,496,870 | A | 6/1924 | Brown | |
| 2,096,676 | A | 10/1937 | Conrad | |
| 3,644,982 | A | 2/1972 | Anderson | |
| 3,718,057 | A * | 2/1973 | Berchtold | 81/15.4 |
| 3,840,967 | A * | 10/1974 | Olson | B25B 27/24 137/328 |
| 3,875,756 | A | 4/1975 | Olson | |
| 3,975,713 | A | 8/1976 | Rivero | |
| 4,305,193 | A | 12/1981 | Anderson | |
| 5,005,375 | A | 4/1991 | Manz et al. | |
| 5,097,580 | A * | 3/1992 | Story | 29/221.5 |
| RE34,781 | E | 11/1994 | Spalink et al. | |
| 6,122,810 | A | 9/2000 | McInnes | |
| 6,152,165 | A | 11/2000 | Fukuda | |
| 6,253,436 | B1 | 7/2001 | Barjesteh et al. | |
| 6,473,965 | B2 | 11/2002 | Levy et al. | |
| 6,612,005 | B2 * | 9/2003 | Rivers | 29/221.5 |
| 6,862,787 | B2 | 3/2005 | Groves | |
| 6,901,947 | B2 | 6/2005 | Danielson et al. | |
| 6,944,924 | B2 | 9/2005 | Hayes | |
| 7,559,245 | B2 * | 7/2009 | Knowles et al. | 73/714 |
| 2008/0190208 | A1 | 8/2008 | Appler et al. | |
| 2011/0197978 | A1 | 8/2011 | Harji et al. | |

* cited by examiner

*Primary Examiner* — Monica Carter
*Assistant Examiner* — Seahee Yoon
(74) *Attorney, Agent, or Firm* — Mathew R. P. Perrone, Jr.; Joseph Whang

(57) ABSTRACT

A valve core gripper device is capable of providing a gripping and a grasping collet, that extends out of the remover end and clips onto the small ball end of a valve core, to insert or remove a valve core. This device has many uses due to available modifications including, but not limited, a tire valve, a refrigerator, and a high pressure tire valve. The device may permit the valve to receive or expel gas.

7 Claims, 17 Drawing Sheets

VALVE CORE GRIPPER DEVICE

CROSS REFERENCE TO RELATED APPLICATION

This application is based on U.S. Patent Provisional Application Ser. No. 61/473,788 as originally filed on Apr. 10, 2011, and is also filed as a continuation in part of U.S. patent application Ser. No. 13/021,727 filed Feb. 5, 2011; both applications being incorporated herein by reference, and having the same inventor as this application.

This invention relates to a valve core gripper device, and more particularly, to be valve core gripper device for removing a valve core from a tire valve or a refrigeration valve, or inserting a valve core into a tire valve or a refrigeration valve.

BACKGROUND OF THE INVENTION

A valve core, also known as a Schrader valve insert, is commonly used to provide access to an item, a device or an apparatus containing gas under pressure. Most commonly, tires on a vehicle have a valve stem with a valve core therein. The valve core provides access for a gas to be put into or removed from a tire. In a refrigeration system, the valve core provides access to the refrigerant for the system for removal or insertion purposes relative to the refrigerant.

Commonly, a valve core can get stuck in either the tire valve or the refrigerant system. This sticking problem with the valve core interferes with maintenance of the tire or a refrigeration system. It is very desirable to be able to remove or insert the valve core without damaging the tire or the refrigeration system. Such a removal is difficult with the tools of the prior art.

With regard to refrigerant system, a typical valve core is a Schrader-type valve core. Any refrigerant system is a closed system to contain the refrigerant gas and provide the necessary cooling. The valve, together with the valve core, provides access to the refrigerant in the system. Through this valve, refrigerant may be added or removed from the system as desired. Great problems occur when the valve core requires replacement. Various problems can occur with the removal of the valve core, especially when it is highly desired not to damage the surrounding area of the valve core.

Various problems can lead to the valve core being stuck in the refrigerant system. Special tools are required to remove that valve core from refrigerant system in order to repair or service that system. Thus, the valve core can and does cause problems, if it becomes stuck in the system. Accordingly, a tool to remove that valve core without damaging the surrounding area can provide a great advantage.

SUMMARY OF THE INVENTION

Among the many objectives of the present invention is the provision of a valve core gripper device capable of gripping a valve core, in order to insert or remove the valve core from a housing, from a tire or a refrigerant system, without damaging the housing.

Another objective of the present invention is the provision of a valve core gripper device capable of serving a refrigerant system.

Yet another objective of the present invention is the provision of a valve core gripper device capable of servicing a tire.

Still another objective of the present invention is the provision of a valve core gripper device, which can be releasably secured to a valve core.

Also, an objective of the present invention is the provision of a valve core gripper device capable of removing the valve core from a tire valve without damaging the valve housing.

A further objective of the present invention is the provision of a valve core gripper device capable of inserting the valve core into a tire valve without damaging the valve housing.

A still further objective of the present invention is the provision of a valve core gripper device capable of removing the valve core from a refrigerant system without damaging the refrigerant system.

Yet a further objective of the present invention is the provision of a valve core gripper device capable of inserting the valve core into a refrigerant system without damaging the refrigerant system.

Another objective of the present invention is the provision of a valve core gripper device capable of servicing a high pressure tire.

These and other objectives of the invention (which other objectives become clear by consideration of the specification, claims and drawings as a whole) are met by providing a valve core gripper device capable of providing a gripping or a grasping collet, that extends out of the remover end and clips onto the small ball end of a valve core, to insert or remove that valve core. This device has many uses due to available modifications including, but not limited, a tire valve, a refrigerator line, and a high pressure tire valve. The device may permit the valve to receive or expel gas.

BRIEF DESCRIPTION OF DRAWINGS

Throughout the figures of the drawings, where the same part appears in more than one figure of the drawings, the same number is applied thereto.

DESCRIPTION OF THE PREFERRED EMBODIMENTS

Figure 1:
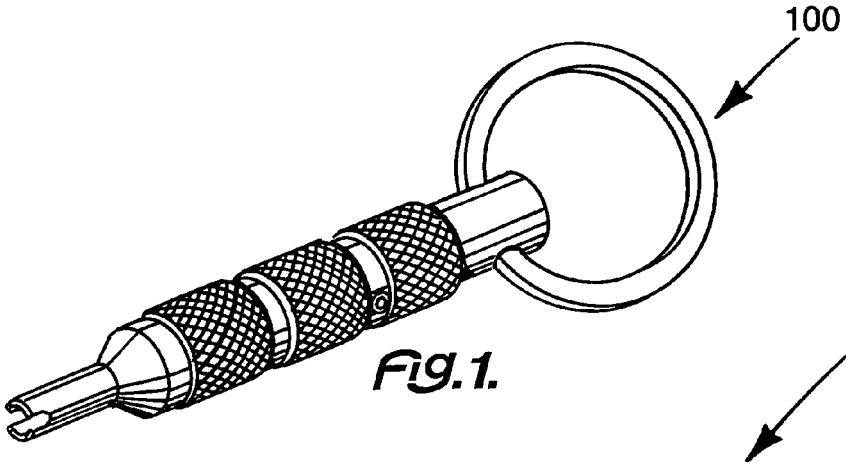
FIG. 1 depicts a perspective view of tire valve wrench 100 of this invention.

Reference will now be made in detail to several embodiments of the invention that are illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, over, above, below, beneath, rear, and front, may be used with respect to the drawings. These and similar to directional terms are not to be construed to limit the scope of the invention in any manner. The words attach, connect, couple, and similar terms with their inflectional morphemes do not necessarily denote direct or intermediate connections, but may also include connections through mediate elements or devices.

The valve core gripper device of this invention is useful in many ways. It is especially suitable for use with a refrigerant valve or tire valve. The valve core gripper device of this invention may also be used with high-pressure tire, after the appropriate modifications are made. From the valve core gripper device, a grasping, collet extends from one end or remover end of the gripper device and attaches to an end of the valve core. Typically, this gripper device can be applied to a Schrader valve core or a tire valve core. The valve core gripper device has a housing. The collet extends from the remover end of that housing to grip the valve core. At the other end or gripping end of the housing is an appropriate gripping device. That gripping device can be a ring, to facilitate handling of the valve core gripper device.

Within the housing is a bias spring, also known as a retractor spring, supported by set screws or other holding device, which permit the collet to extend from the housing and grasp the valve core. With such a strong grip on the valve core, it becomes easy to insert or remove the valve core without damaging the surrounding area. O-rings can be used for supporting pressure in the housing to hold the valve core as desired.

The bias spring may be inserted into the housing and the retractor assembly. The retractor assembly includes the key ring, the retractor hanger handle, the housing and the grasping surface on the outside of the housing. A set screw in cooperation with the retractor assembly holds the spring in the desired position. The screw is adjusted so that the retractor handle assembly may slide easily in the housing without falling apart. The retractor handle may have an angled recess, which permits the twisting thereof a full 360 degrees.

A user may slide fingers into the key ring for an over-the-top attack on the valve core, and operate the housing with the thumb and middle finger, while using the first finger to retract the handle and the cowling against the tension of the spring. This action extends the grasping collet to securely contact the valve core, and remove the valve core from the housing or insert the valve core. The user has the hollowed out end of the grasping collet to latch on to the valve core.

After releasing the retractor and spring tension, the user may fold the grasping collet back into the housing of the valve core remover, thereby locking the grasping collet securely around the valve core and holding valve core securely. A user may then twist housing until the notch at the remover end of the housing slides over the valve core. The valve core may be twisted out of the housing counterclockwise or inserted therein clockwise.

The valve core tool can be made of high impact plastic, metal, composite materials or combinations thereof. It may or may not need a typical metal spring. The plastic pieces can be snap fitted or snapped together. Thus, a fastener may not be needed to hold the valve core tool together.

The preferred material to construct the device is stainless steel because of the strength of that material and, more importantly, its anti friction properties. In the high areas of its use, strength is important. Anti friction properties are important to avoid undue heat and other possible dangers.

The valve core tool can easily be reconfigured into many shape and sizes For example, a screw driver size device for easier handling is available. Additionally, the valve core tool may also include a storage area for extra valve cores. Then a tire pressure gauge can also be included.

The valve core tool can be used to easily deflate tires of all sorts simply by placing the tip of the tool into the valve stem and pressing the button. While the valve core tool does not need to be attached to the valve core to accomplish this task, it can be attached as well.

The valve core tool can be constructed with less parts than shown and function similarly. For example, the gripper portion of the device may be constructed with less than 4 or more than 4 gripper fingers.

Figure 6:
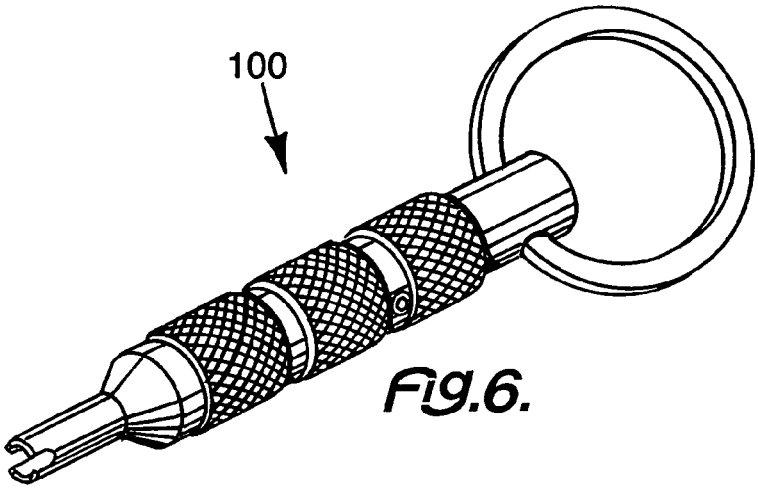
FIG. 6 depicts a perspective view of tire valve wrench 100 of this invention.
Figure 7:
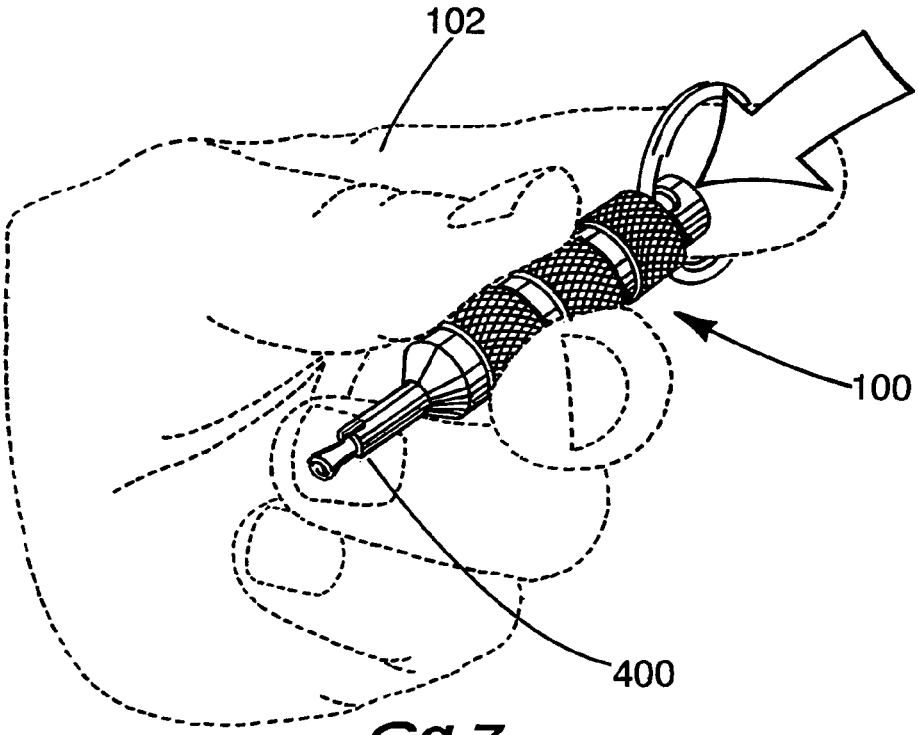
FIG. 7 depicts a hand 102 gripping the tire valve wrench 100 of FIG. 6.
Figure 8:
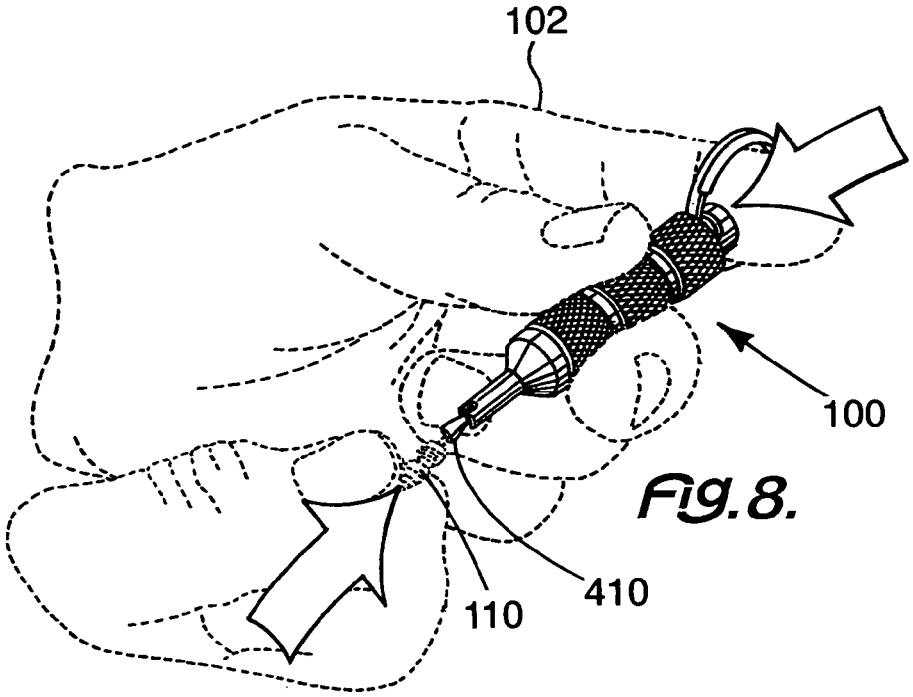
FIG. 8 depicts a hand 102 gripping the tire valve wrench 100 of FIG. 6 with tire valve 110.
Figure 9:
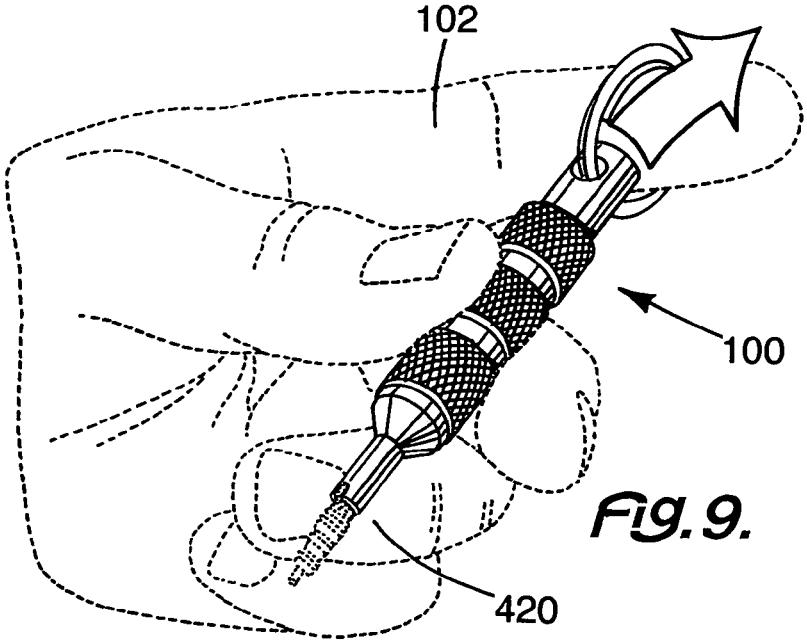
FIG. 9 depicts a hand 102 gripping the tire valve wrench 100 of FIG. 6 with tire valve 110 mounted therein.
Figure 10:
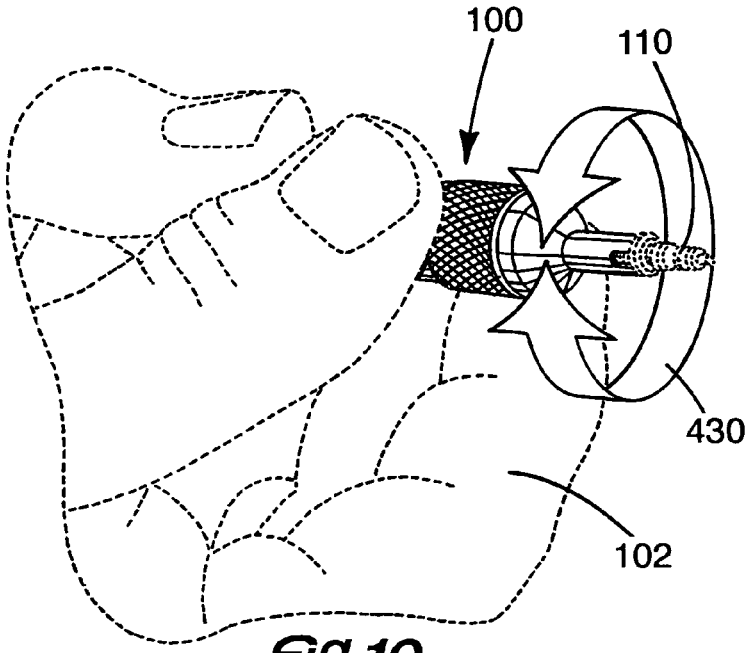
FIG. 10 depicts a hand 102 gripping the tire valve wrench 100 of FIG. 6 with tire valve 110 mounted therein, along with the desired movement.
Figure 11:
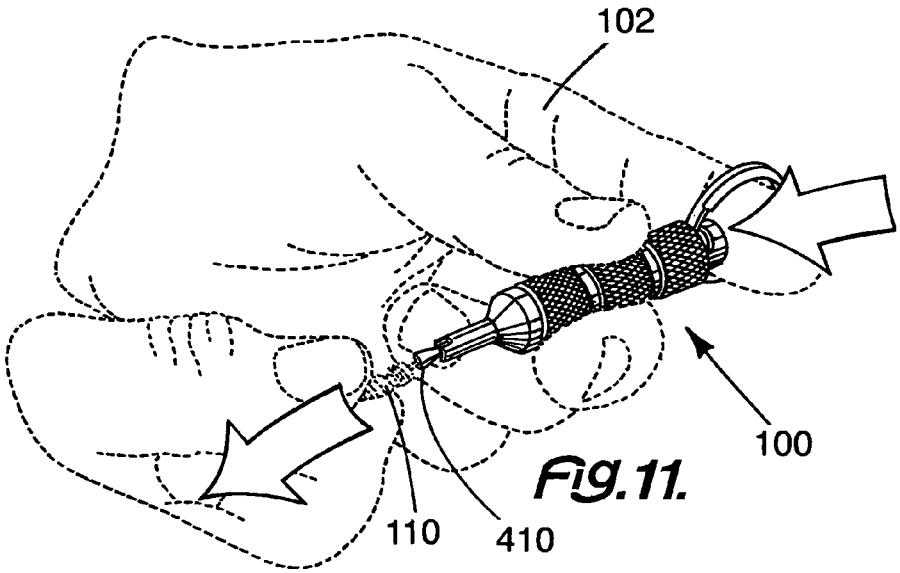
FIG. 11 depicts a hand 102 gripping the tire valve wrench 100 of FIG. 6 with tire valve 110 being removed therefrom.

In FIG. 1 and FIG. 6, the tire valve core wrench 100 is depicted. A pushbutton 114 is at a removal end of tire valve core wrench 100 in order to operate tire valve core wrench 100. Within the pushbutton 114 is a holding ring 126, which is received in ring aperture 128. Knurled grip 144 on housing body 148 facilitate gripping of the tire valve core wrench 100. Set screw 154 helps assemble the tire valve core wrench 100. Oppositely disposed from the pushbutton 114 is the gripper canal 168 and the wrench slot 158 forming a remover end of the valve core wrench 100. The remover end may also serve an insertion function if desired. Extending from the wrench slot 158 is the extender 400, having valve engaging tip 420.

Figure 2:
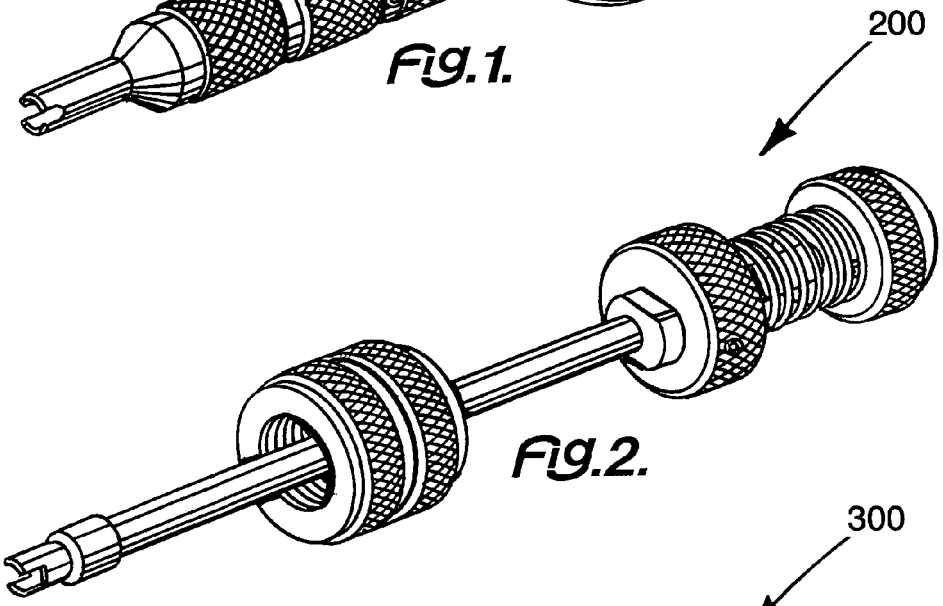
FIG. 2 depicts a perspective view of refrigerator valve wrench 200 of this invention.
Figure 16:
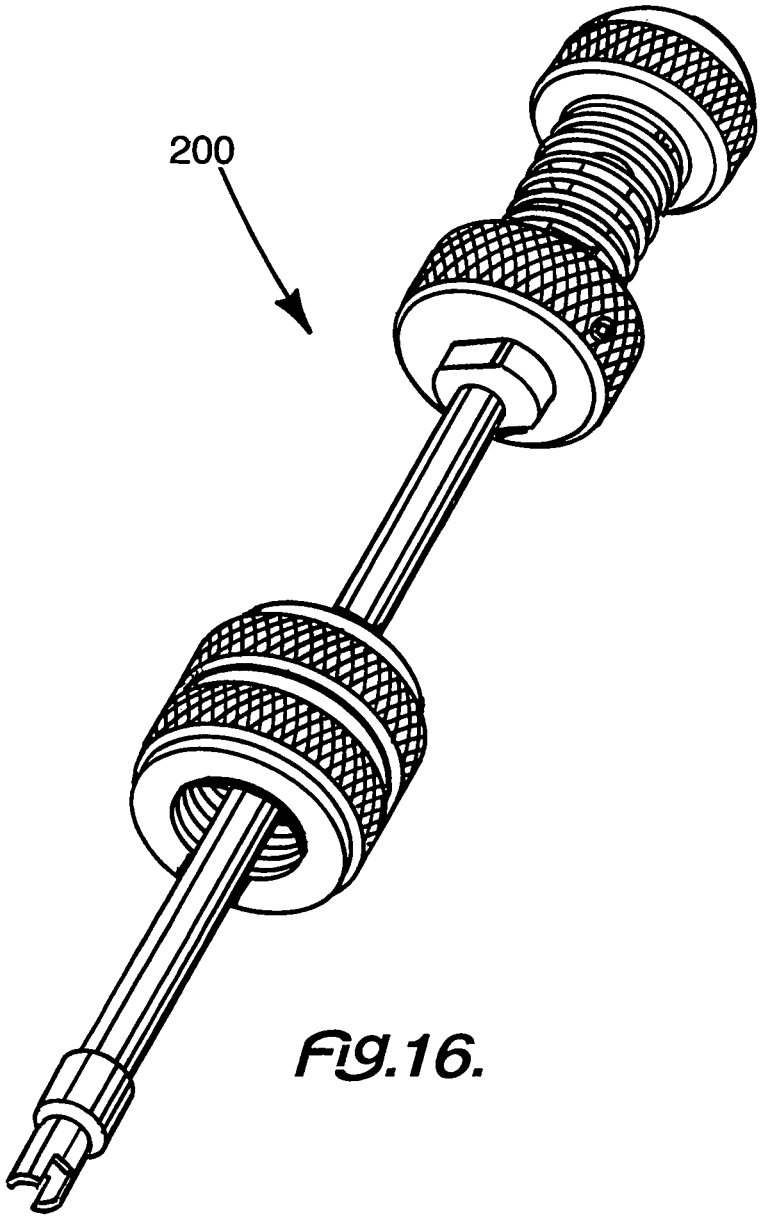
FIG. 16 depicts a perspective view of refrigerator valve wrench 200 of this invention, as retracted.

Turning now to FIG. 2 and FIG. 16, refrigeration valve core puller 200 is depicted. At one end of the refrigeration valve core puller 200 is extractor button 206. Extractor button 206 contacts a retractor spring 140 mounted between the knurled grip 144 and the extractor button 206. The retractor spring 140 facilitates the operation of this device. A slide adapter 210 is extends below the knurled grip 144. The extractor housing tube 230 extends from the knurled grip 144 through the slide adapter 210 and terminates at the extractor tip 268, which serves as a remover end or an insertion end for valve core 110. The extractor 236 can grip and control the Schrader valve insert or valve core 110 in a refrigeration line 122 (FIG. 4).

Figure 3:
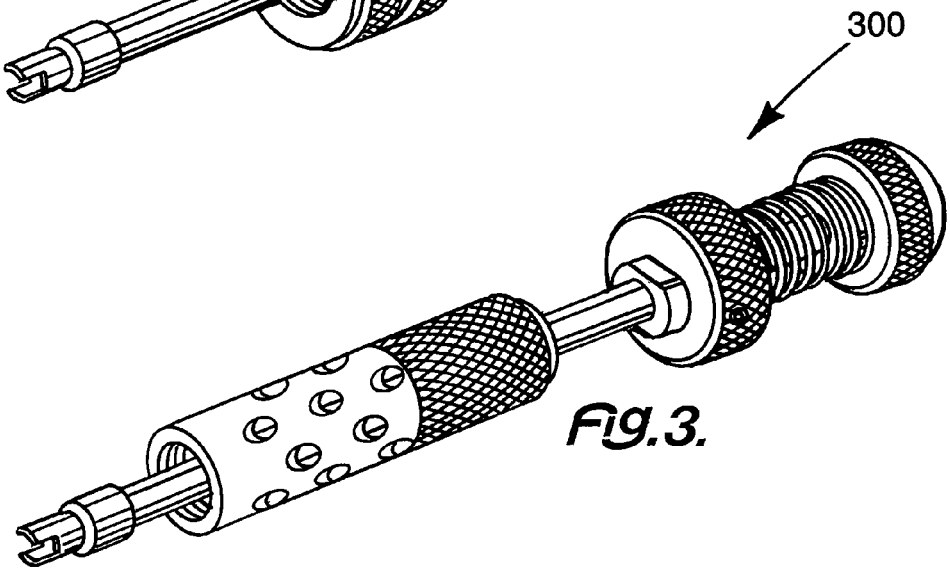
FIG. 3 depicts a perspective view of tire valve wrench 100 of this invention with a high-pressure tire valve core remover 300.
Figure 22:
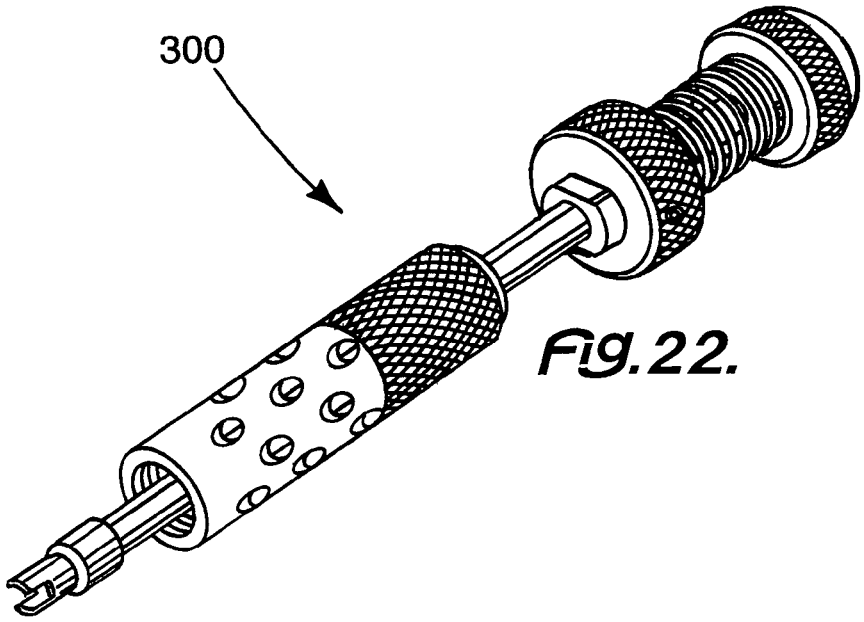
FIG. 22 depicts a perspective view of high-pressure tire valve core remover 300.
Figure 23:
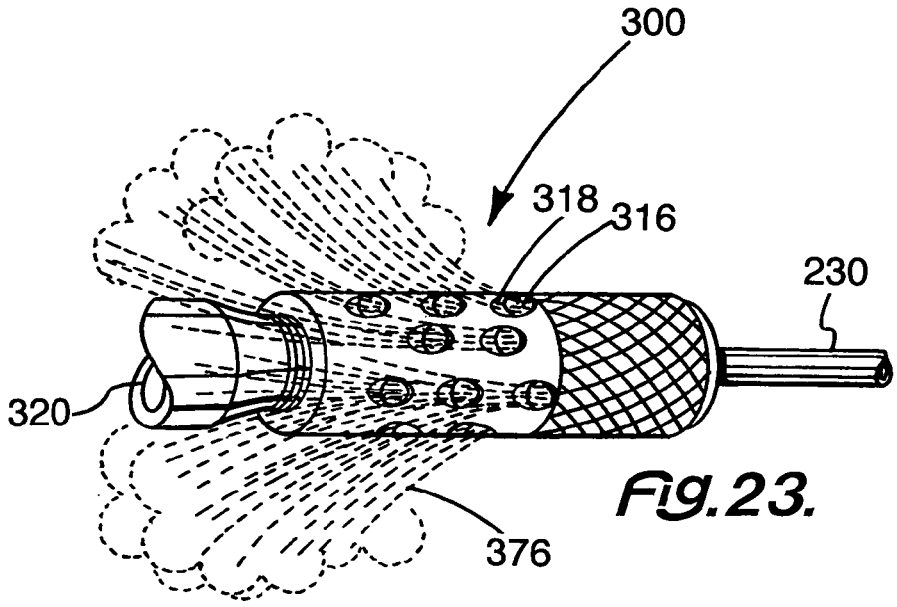
FIG. 23 depicts a perspective view of high-pressure tire valve core remover 300 in use.

Now adding FIG. 3, FIG. 22, and FIG. 23 to the consideration, modifications to provide a high-pressure valve core remover 300 are depicted. Extractor button 206 at one end of high-pressure valve core remover 300 operates retractor spring 140. Knurled grip 144 indicates a position of the retractor spring 140 on the retracting shaft 236 adjacent to the extractor button 206. Retaining collar 132 on retracting shaft 236 holds knurled grip 144 in the desired position. Slide aperture 280 in safety relief adapter 310 receives retracting shaft 236, which serves as a remover end or an insertion end for valve core 110.

Exhaust vents 316 are apertures in safety relief adapter 310, which permit the escape flow 376 of air or gas from high-pressure tire 320 when attached to tire male coupling 380. Such flow is better due to deflective edge 318 on exhaust vents 316. Female coupling threads 246 being in safety relief adapter 310 are oppositely disposed from the slide aperture 280. Safety relief adapter 310 combines with female coupling threads 246 for a positive grip on the high pressure tire 320, in order to provide for inflating or deflating the high pressure tire 320.

Figure 4:
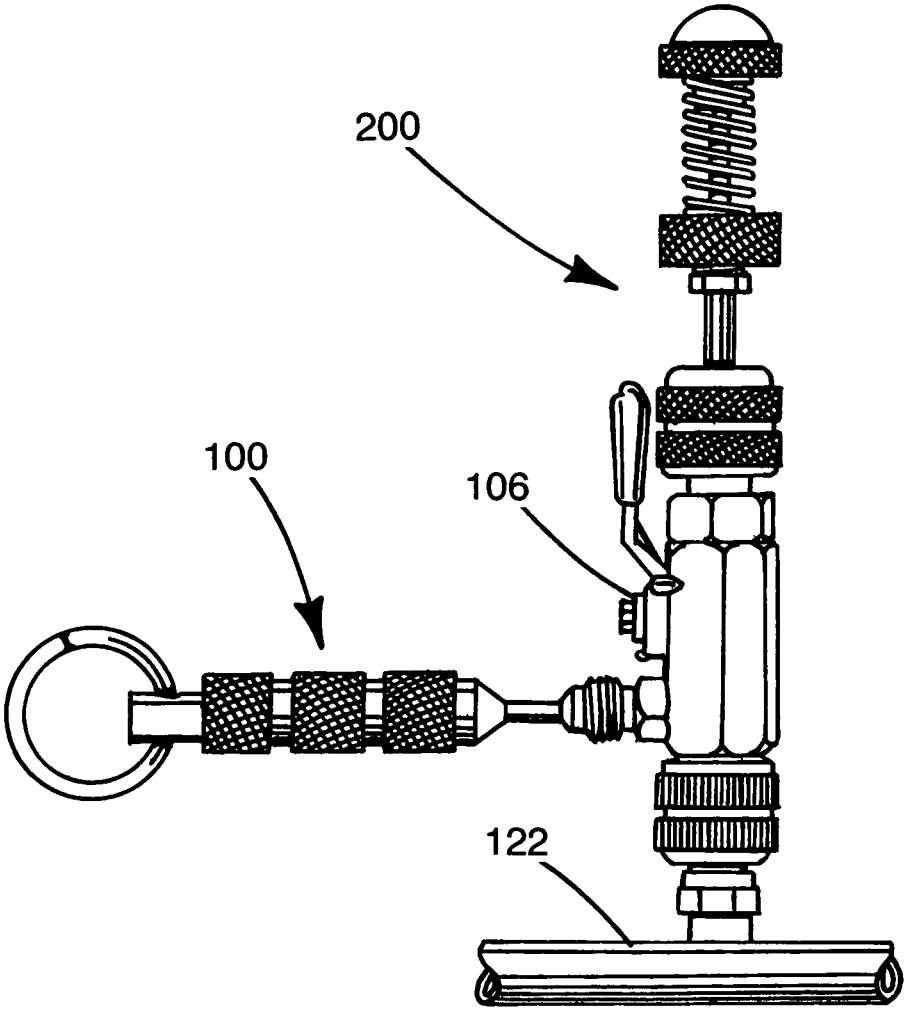
FIG. 4 depicts a plan view of tire valve wrench 100 and refrigerator valve wrench 200 being used jointly on a refrigerator valve 106.
Figure 5:
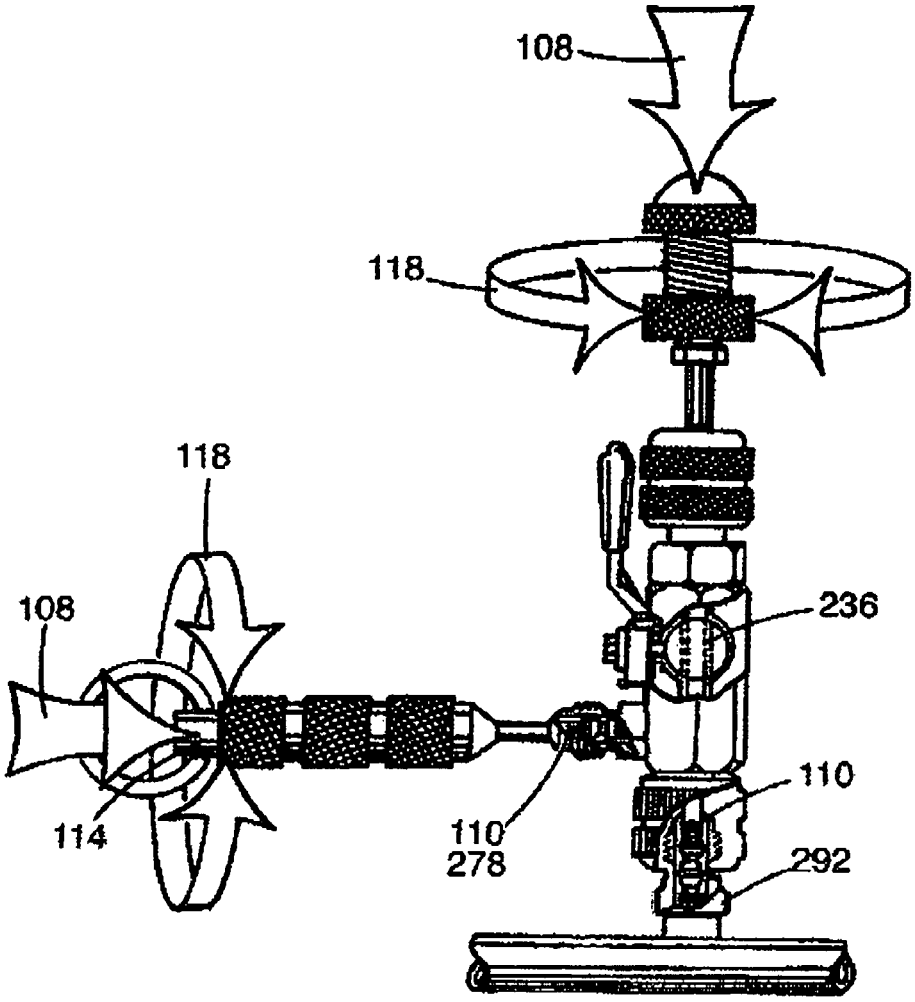
FIG. 5 depicts FIG. 4 modified with cutaway views to show the function of tire valve wrench 100 and refrigerator valve wrench 200.

Now moving on to FIG. 4 and FIG. 5, shutoff valve 106 on refrigerant line 122 effectively uses both the tire valve core wrench 100 and the refrigerator valve wrench 200. Each of tire valve core wrench 100 and refrigerator valve wrench 200 is operated by an arrow indicating straight push control action 108. Working with straight push control action 108 and twist control 118 moves extractor 236 to valve core 110 or to refrigeration filler valve 292, which serves as a remover end or an insertion end for valve core 110. Bleeder valve 278 is also present on tire valve core wrench 100 or refrigerator valve wrench 200 in order to facilitate pressure reduction in the system.

Thus, it may be seen how tire valve core wrench 100 and refrigerator valve wrench 200 cooperate to provide service to a refrigerant line 122. The twist control 118 along with the pushbutton 114 on them provide for good control of valve core 110 removal or insertion.

The workings of valve core wrench 100 are clarified in FIG. 7, FIG. 8, FIG. 9, FIG. 10, and FIG. 11. Hand 102 operates extender 400 with the help of pushbutton 114, twist control 118, and holding ring 126. Holding ring 126 directs the hand 102 over the pushbutton 114. Extender 400 on the end of removal tool 440 protrudes or is retracted, depending on operation of pushbutton 114.

Figure 12:
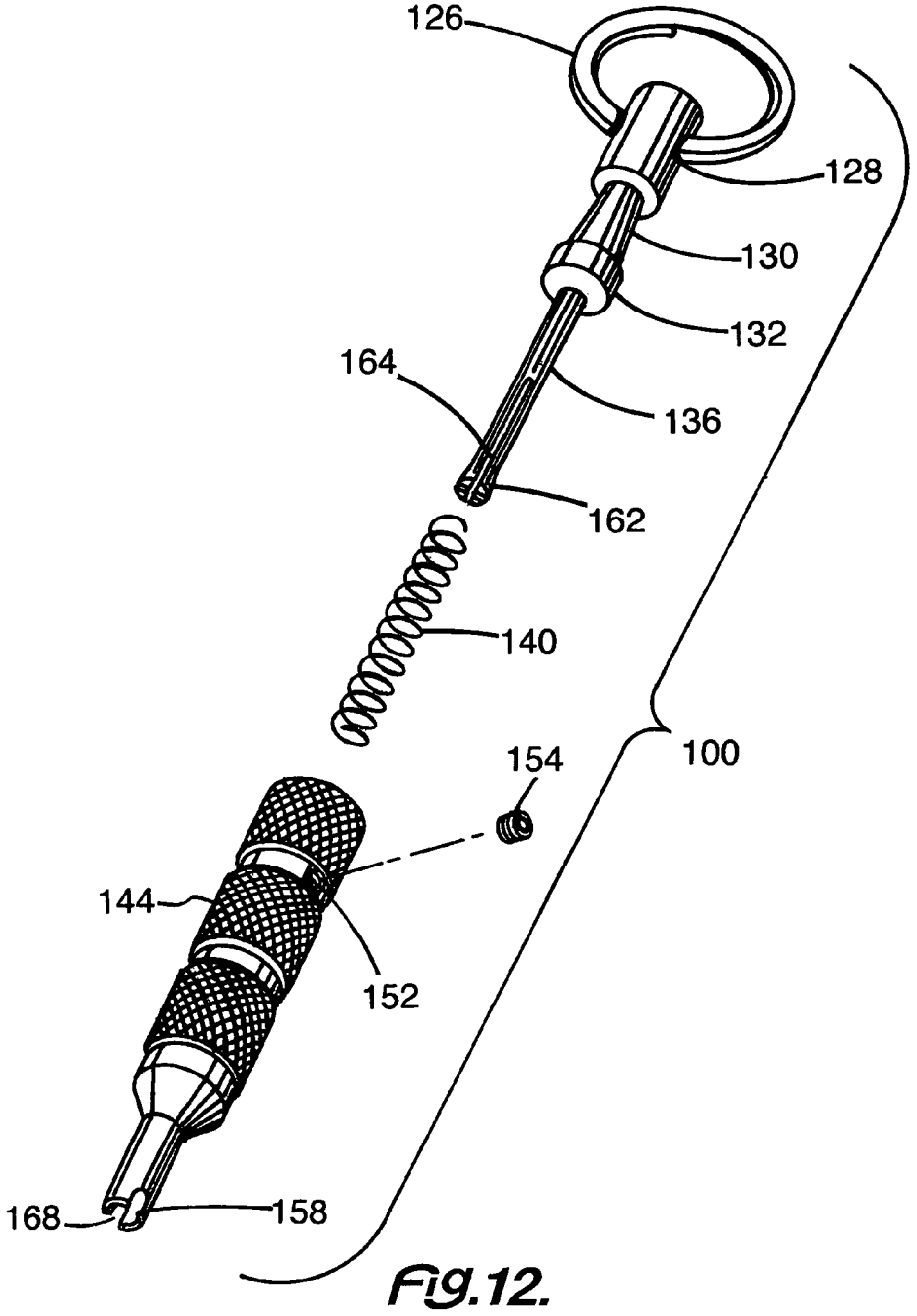
FIG. 12 depicts an exploded, perspective view of tire valve wrench 100 of this invention.

In FIG. 12, retracting shaft 136 extends from retaining collar 132 and ends with gripper portion 162. In gripper portion 162 is longitudinal slot 164. Retractor spring 140 fits over retracting shaft 136 and within housing body 148. Also, taper adjustment shaft 130, retaining collar 132, retracting shaft 136, gripper portion 162 and longitudinal slot 164 fit within housing body 148.

Knurled grip 144 on the exterior of housing body 148 adds an extra measure of control to the tire valve core wrench 100. Above knurled grip 144 is threaded aperture 152, which receives an adjustment screw in the form of set screw 154 in FIG. 13. Housing body 148 terminates in wrench slot 158. Wrench slot 158 includes wrench tip 160 (FIG. 13) with gripper canal 168. Gripper canal 168 receives valve core 110.

With clip on 410 (FIG. 11), tire valve core puller 100 can receive valve core 110. With reversible twisting device 430 (FIG. 10), hand 102 may move the valve core 110 in or out of housing body 148.

Figure 13:
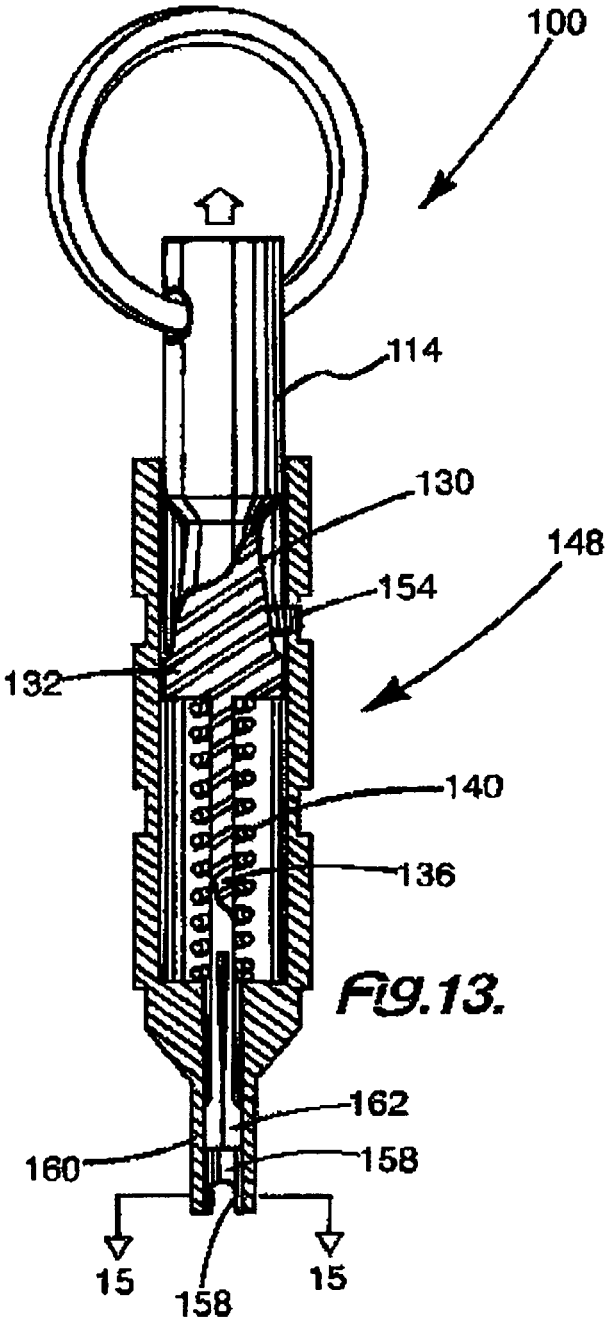
FIG. 13 depicts a partial, cross-sectioned view of tire valve wrench 100 of this invention.
Figure 14:
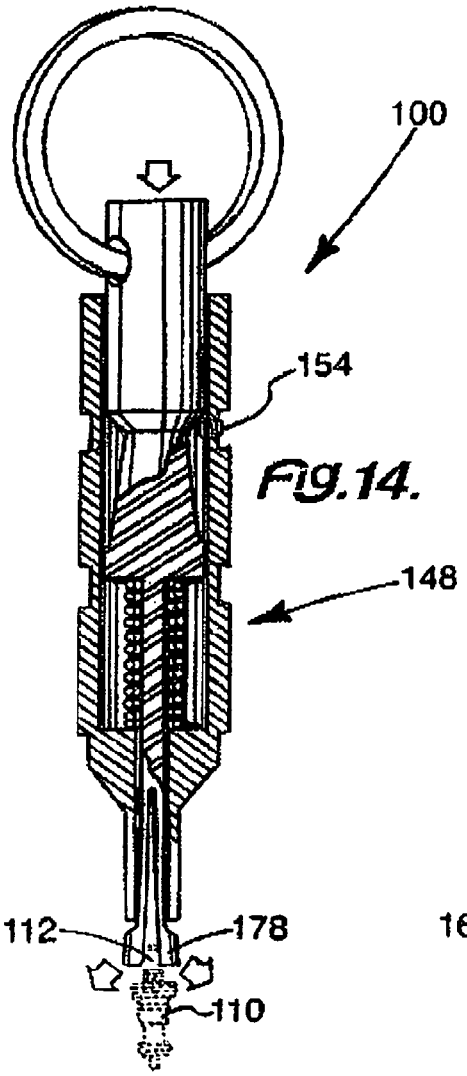
FIG. 14 depicts a partial, cross-sectioned view of tire valve wrench 100 of this invention holding tire valve 110.

FIG. 12 combines with FIG. 13 and FIG. 14 to further show the structure of tire valve core wrench 100. Holding ring 126, for items such as keys, fits through ring aperture 128 in pushbutton 114. Pushbutton 114 leads to taper adjustment shaft 130, which in turn leads to retaining collar 132. The structure of gripper canal 168 fits around valve core 110 for removal or insertion thereof. Wrench slot 158 is formed by opposing U-shaped slots in wrench tip 160. Gripper portion 162 includes longitudinal slot 164 of gripper canal 168. Twist control 118 provides for the engaging tip 420 to have a twist in and out movement 430 thereby grip and thereby grip valve core 110 as desired.

Travel stop 134 is a taper on the pushbutton 114, which cooperates with set screw 154 to limit the travel of pushbutton 114. The retracted position 172 for gripper canal 168 (FIG. 13) provides storage when tire valve wrench 100 is not in use. The extended position 174 permits use of the gripper canal 168 when use is desired for tire valve wrench 100.

Figure 15:
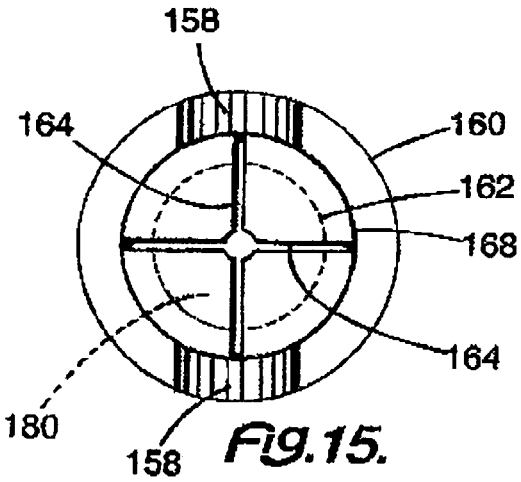
FIG. 15 depicts a bottom plan view of tire valve wrench 100 of this invention showing wrench tip 160.

With the addition of FIG. 15, the structure of gripper canal 168 becomes even clearer. Again, wrench slot 158 is formed by opposing U-shaped slots in wrench tip 160. Gripper portion 162 includes longitudinal slot 164 of gripper canal 168. Spherical cavity 180 receives ball portion of valve core 110 and remains concealed in gripper portion 168 until use thereof is desired. When use of tire valve core wrench 100 is desired, pushbutton 114 activated to extend gripper portion 162.

With FIG. 16, uses of refrigerator valve wrench 200 or high-pressure tire valve core remover 300 are depicted showing some common parts therebetween. As a part of knurled grip 144, extractor button 206 is held in place when threaded aperture 212 receives set screw 214. Retractor spring 140 is positioned between extractor button 206 and slide adapter 210. Knurled grip 144 is on the outside of slide adapter 210. Within slide adapter 210 are inner O-ring 220 and outer O-ring 224 for sealing purposes.

A threaded bushing end 132 is received in threaded relation with clockwise female threads 206, which are positioned on an end of extractor housing tube 230. Oppositely disposed from the threaded bushing end 132 on extractor housing tube 230 are counterclockwise male threads 232. Extractor 236 fits within extractor housing tube 230, with a screw flat 238 therein and a longitudinal slot 164 thereon and oppositely disposed from the screw flat 238.

Slide aperture 280 in coupling collar 242 receives extractor housing tube 230. Knurled grip 144 facilitates use of coupling collar 242. Second O-ring 252 and third O-ring 254 support seal collar 256 within coupling collar 242. First O-ring 250 also supports the seal collar 256 against threads 246 within coupling collar 242.

Figure 17:
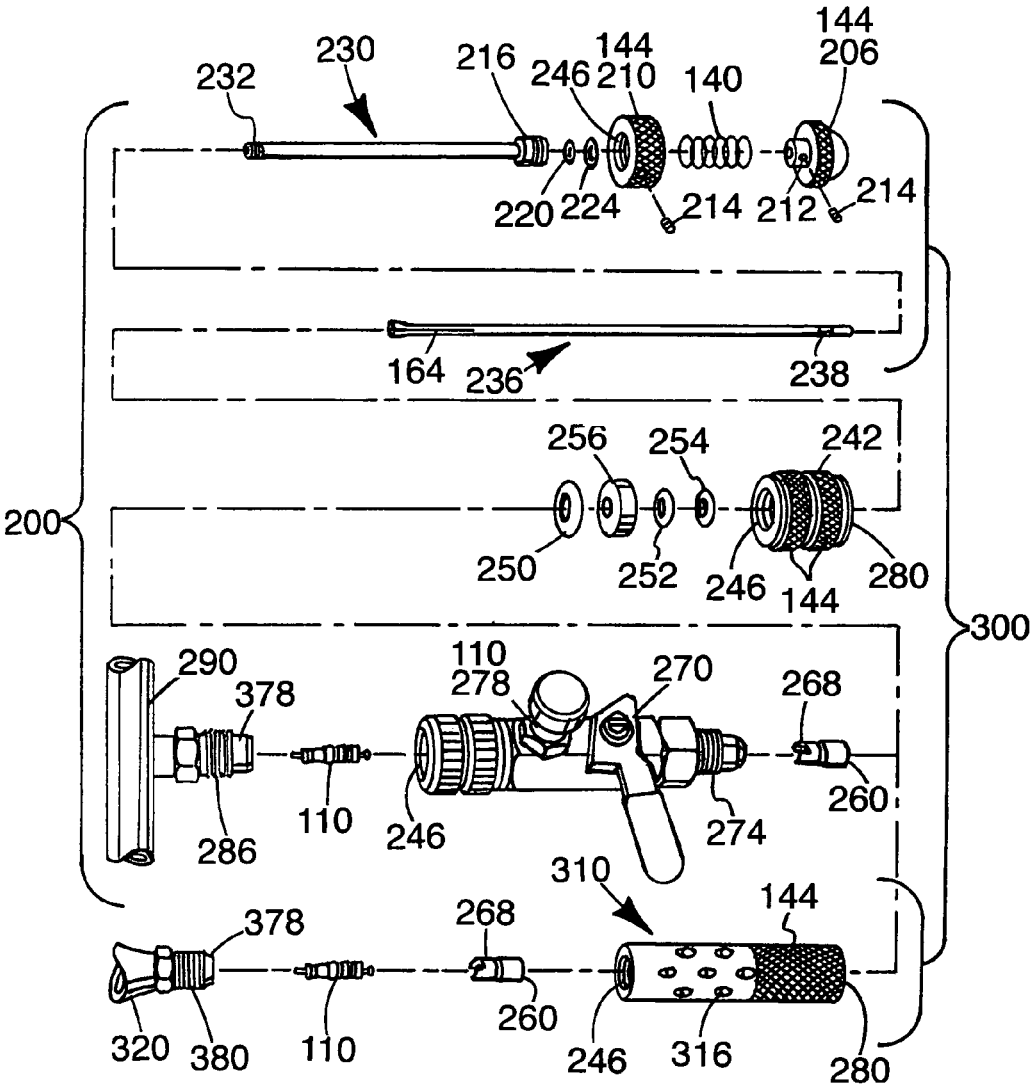
FIG. 17 depicts a exploded view of refrigerator valve wrench 200 for use refrigerator valve 282 and high-pressure wrench 300 in use on a high pressure tire 320.

Considering now the refrigeration line 290 of FIG. 17, valve wrench 268 includes counterclockwise female threads 260 for attachment to the extractor housing tube 230. Female coupling threads 246 on refrigerant shut off valve 270 join with refrigerant male coupling 286, thereby securing the refrigerant shut off valve 270 to the refrigerant line 290. Male coupling threads 274 are also on an end of refrigerant shut off valve 270 and oppositely disposed from female coupling threads 246. Valve wrench 268 can pass through the refrigerant shutoff valve 270 and contact valve core 110, for insertion or removal thereof.

From coupling collar 242, operation on the high pressure tire 320 is also possible with this assembly. The safety release sleeve 310 also has slide aperture 280, with a knurled grip 144 on the outside thereof. Safety release sleeve 310 includes exhaust vents 316 to compensate for the high pressure tire 320 at the tire male coupling 380 thereof. Valve wrench 268 can only pass through the end of the safety release sleeve 310 at female coupling threads 246 and contact valve core 110, for insertion or removal thereof, relative to the high pressure tire 320.

Figure 18:
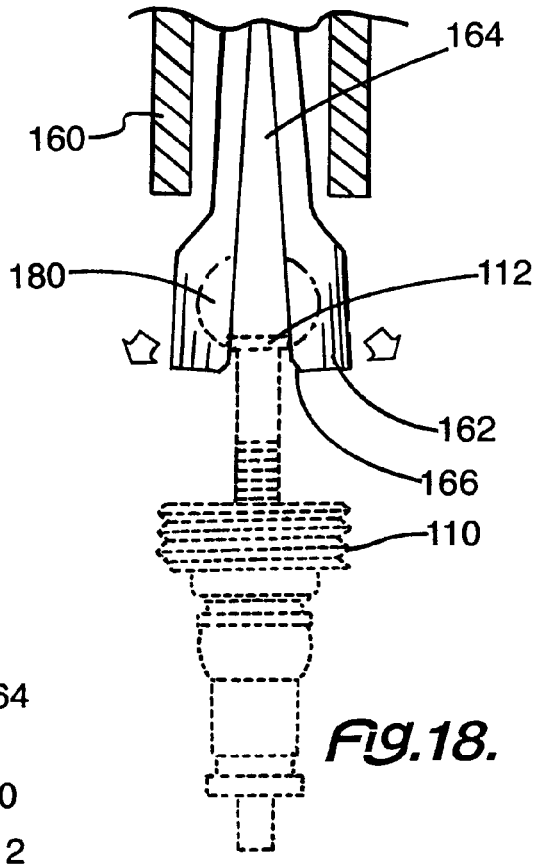
FIG. 18 depicts a partially cross-sectioned view of wrench tip 160 in use.
Figure 19:
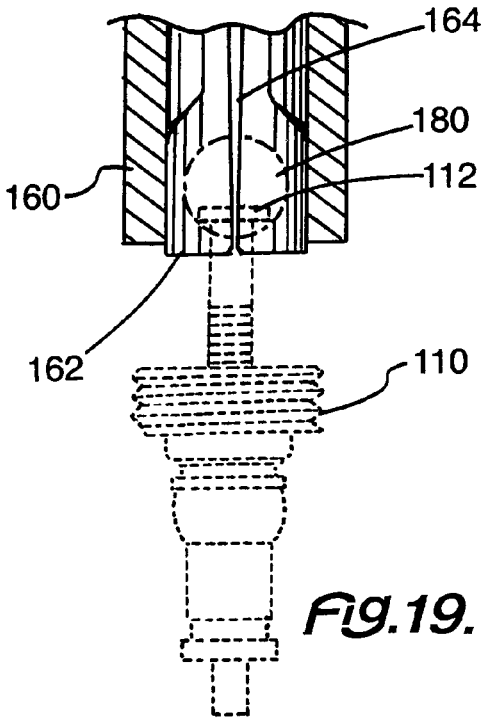
FIG. 19 depicts a partially cross-sectioned view of wrench tip 160 in use and holding tire valve 110 within the tire valve wrench 100.

Referring now to FIG. 18 and FIG. 19, the function of wrench tip 160 becomes even clearer. The stem head 112 of the valve core 110 is positioned within spherical cavity 180 gripper portion 162 of the longitudinal slot 164. A camphor portion 166 interior gripper portion 162 facilitates contact with valve core 110. A spherical cavity 180 within gripper portion 162 facilitates such a grip. Thus, the function of the wrench tip 160 is greatly facilitated when removing or inserting the valve core 110.

Figure 20:
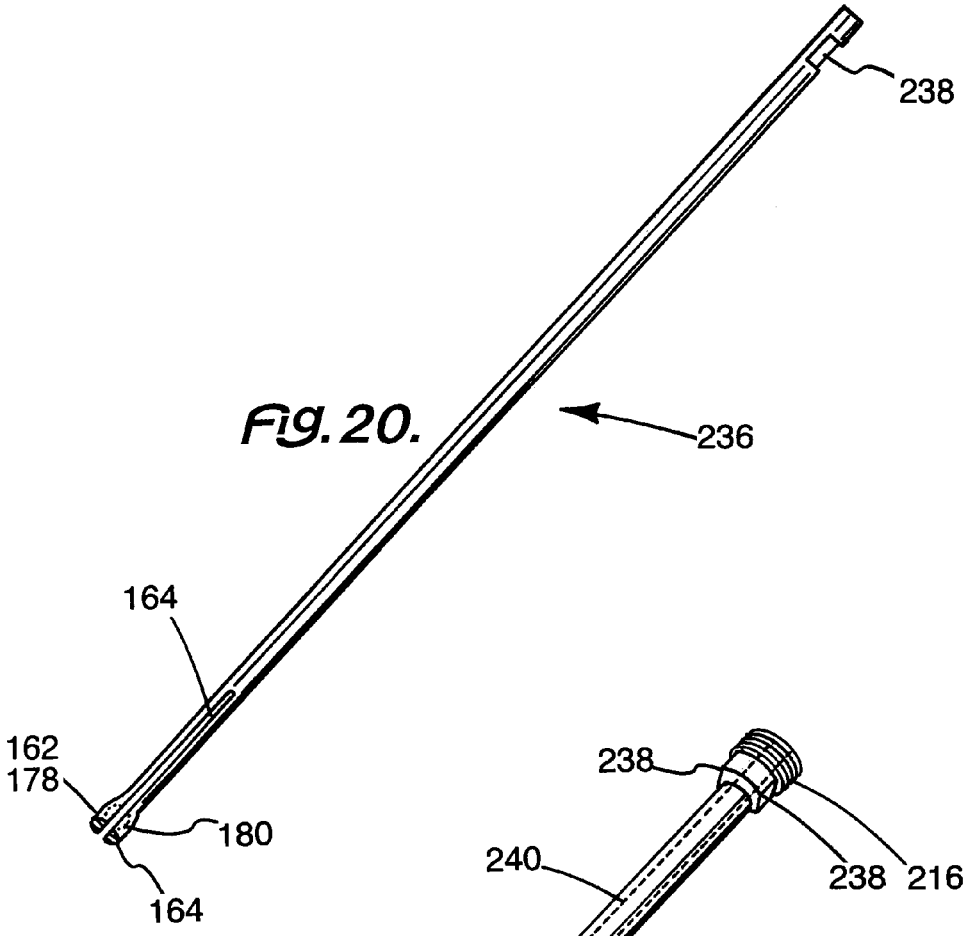
FIG. 20 depicts a plan view of extractor 236 for refrigeration valve core puller 200.

To further clarify extractor 236, one considers now FIG. 20. Screw flat 238 is at one end of extractor 236 and permits extractor 236 to be fastened to the second pushbutton 206 in FIG. 17. At the other end on extractor 236 is longitudinal slot 164, which includes spherical cavity 180, also with gripper portion 162 and grappling collet 178 at the end of extractor 236.

Figure 21:
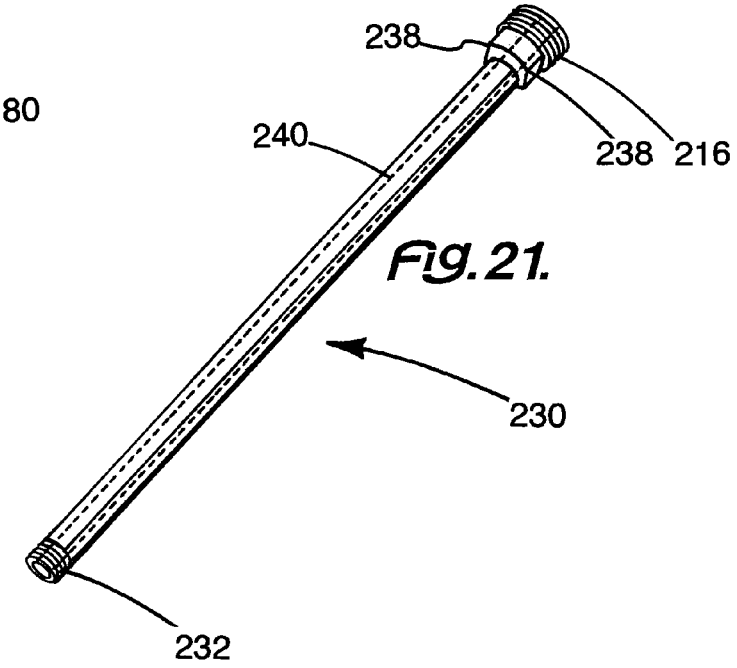
FIG. 21 depicts a plan view of extractor housing tube 230 for the refrigeration valve core puller 200.

With FIG. 21, the extractor housing tube 230 has an extractor canal 240 to receive the extractor 236 of FIG. 20. A threaded bushing end 216 positioned at the end housing tube 230 permits attachment thereof to the knurled collar 210, in which O-ring seals 220 and 224 sit. Adjacent to the threaded bushing end 216 is coupling collar 242. A counter clockwise male thread 232 is at the end of and oppositely disposed from the threaded bushing end 216. Counter clockwise male thread 232 receives wrench tip 260.

Figure 24:
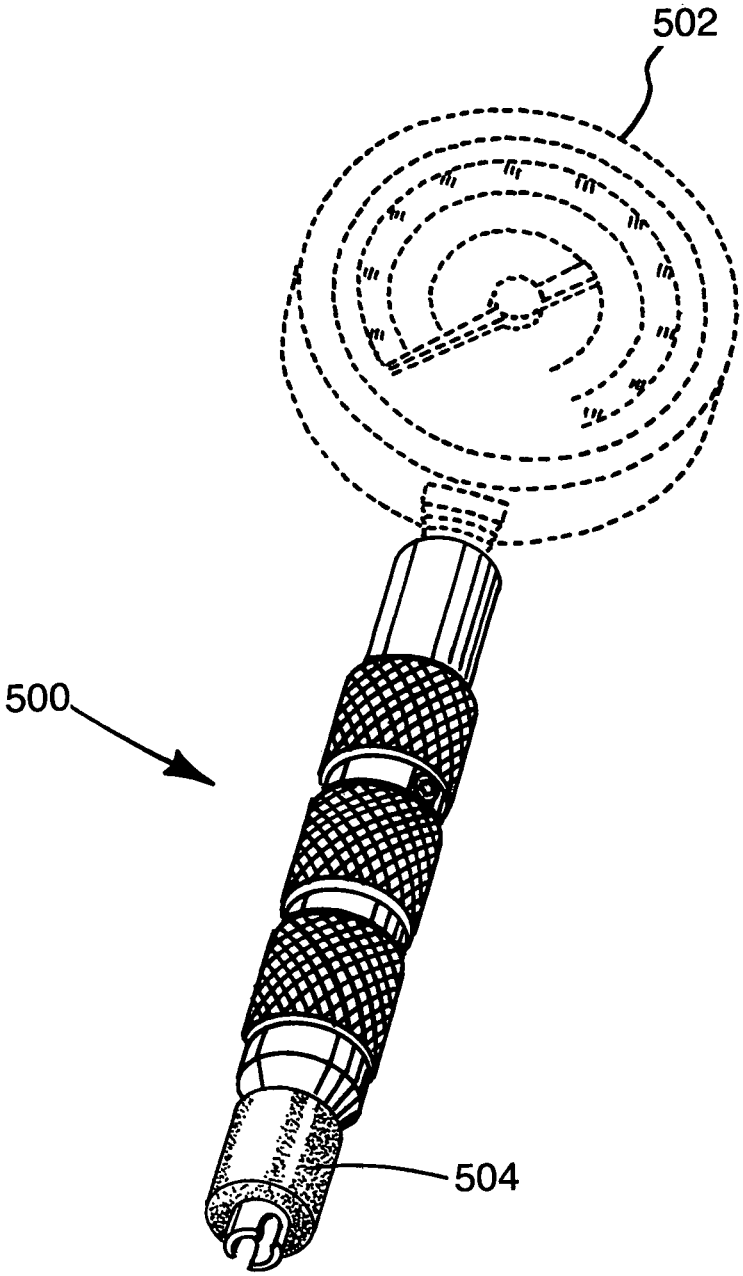
FIG. 24 depicts a perspective view of valve gauge tool 500.
Figure 25:
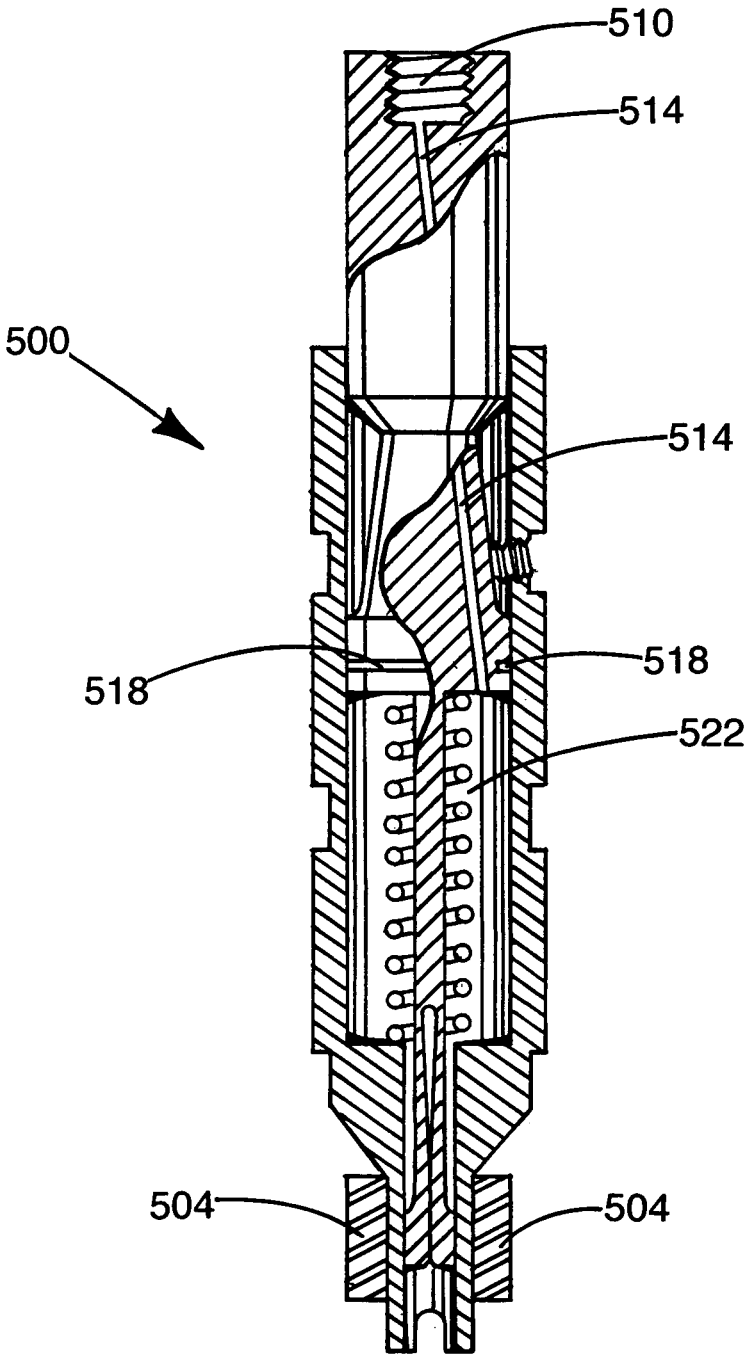
FIG. 25 depict a side, cross-sectioned view of valve gauge tool 500 based on FIG. 24.

With FIG. 24 and FIG. 25, valve gauge tool 500 is defined. Pressure gauge 502 fits into threaded relation with female threads 510 in pushbutton 114. Air canal 514 communicates with pressure gauge 502 and cylinder 522. the windowsill 518 surround tapered adjustment shaft 130 and facilitates the operation of pressure gauge 502. To control air flow, a seal sleeve 504 is positioned around collet 178.

Figure 26:
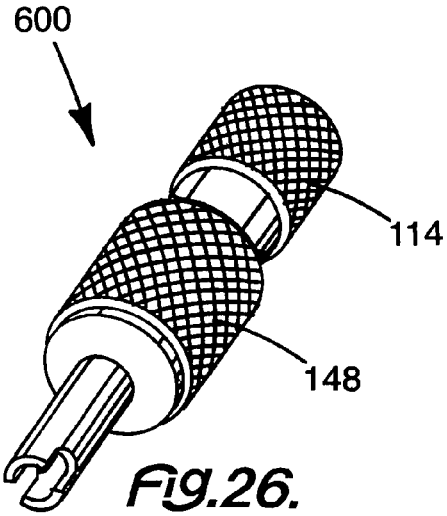
FIG. 26 depicts a perspective view of housing 148, with pushbutton 114.

With FIG. 26, the molded plastic gauge 600, housing 148 can be formed with pushbutton 114 from molded plastic. The molded plastic parts can be glued, snap fitted, or assembled in another appropriate way.

Figure 27:
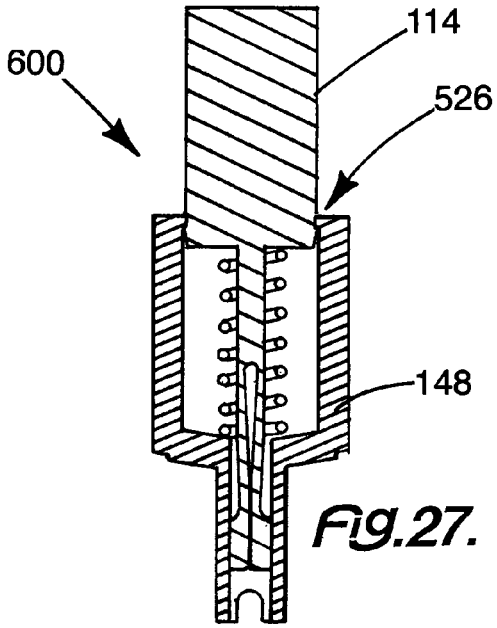
FIG. 27 depict a side, cross-sectioned view of housing 148, with pushbutton 114 based on FIG. 26.
Figure 28:
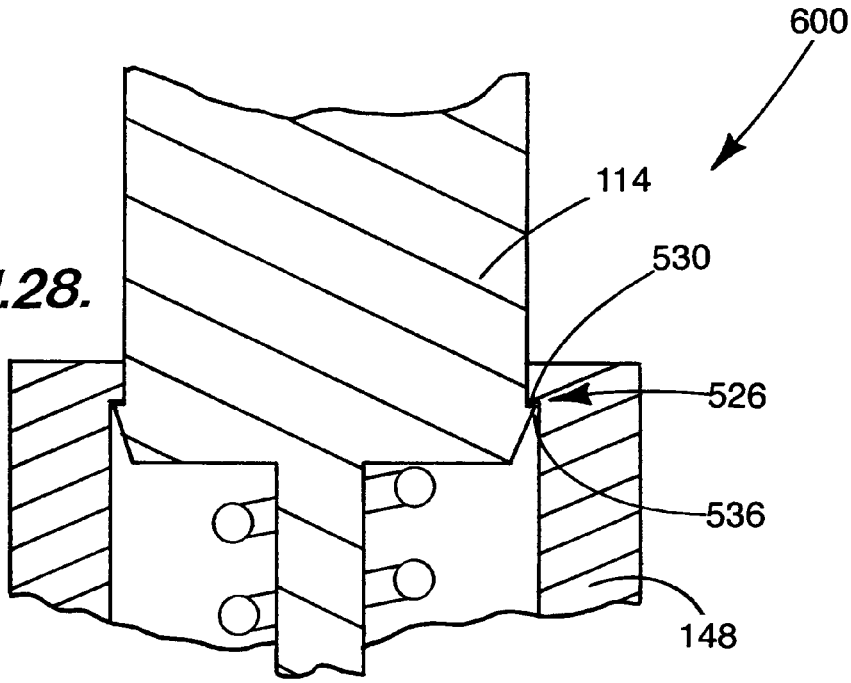
FIG. 28 depict a side, cross-sectioned view of assembly lock 526 based on FIG. 27.

Turning now to FIG. 27 and FIG. 28, housing 148 cooperates with pushbutton 114. Pushbutton 114 forms part of assembly lock 526 with lock collar 530 thereon. Then lock collar 530 cooperates with rim stop 536 on housing 148 to complete assembly lock 526.

Referring now to FIG. 29, the flexibility of valve core grip 550 is shown. Valve core grip 550 can be adapted to form valve core tool 100 (FIG. 1), refrigerator valve wrench 200 (FIG. 2), high-pressure tire valve core remover 300 (FIG. 3), or other suitable configurations.

The valve core grip 550 can be made almost entirely out of high impact plastic or composite materials, as well as metal or combinations thereof. It includes housing structure 552. It may or may not need a typical metal spring. The plastic pieces can be snap fitted or snapped together. Thus, a fastener may not be needed to hold it together.

The valve core grip 550 has an extending device 554 with core gripper 556 thereon. Core gripper 556 may be constructed with less than four or more than four gripper fingers. Core gripper 556 may continue with a cylindrical gripping area, a spherical gripping area or other desired shape. Other options include an optional tire gauge 558 or a storage compartment 560 cooperating with the valve core tool 100. For example, storage compartment 560 may store additional valve cores 110.

This application—taken as a whole with the abstract, specification, claims, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this tool can become clear to a person having ordinary skill in this particular art. Such modifications are clearly covered by this disclosure.

What is claimed and sought to be protected by Letters Patent is:

1. A valve core gripper device capable of gripping a valve core, in order to insert or remove a valve core from a housing of a tire valve or a refrigerant system, comprising:

the valve core gripper device having a gripper housing;

the gripper housing having a gripper end oppositely disposed from a removal end;

a grasping collet being mounted in the gripper housing;

the grasping collet being extendible from or retractable into the removal end;

the grasping collet being attachable to or removable from a valve core;

the gripper housing including a retractor spring;

the retractor spring cooperating with the grasping collet for extending or retracting thereof;

the grasping collet permitting removal or insertion of the valve core as desired;

the valve core gripper including a retractor assembly;

the retractor assembly including a key ring, the gripper housing and a grasping surface on the outside of the gripper housing;

at least one set screw supporting the retractor spring;

at least one O-ring supporting pressure in the gripper housing to hold the valve core as desired;

a pushbutton operating the tire valve core wrench;

the pushbutton having a ring aperture therein;

the key ring fitting into the ring aperture;

the grasping surface including a knurled grip on the gripper housing;

the removal end having the grasping collet with a gripper canal and a wrench slot;

the removal end serving a removal function and an insertion function;

the pushbutton having a twist control in order to move an extractor to or from the valve core;

the extractor serving as the removal end or the gripper end for the valve core;

the valve core gripper device including an extender to contact the valve core;

the pushbutton and the twist control controlling the extender;

the twist control cooperating with the extender;

the extender being positioned on an end of the valve core gripper device for inserting or removing the valve core;

a retracting shaft extending from a retaining collar in the gripper housing for the valve core wrench;

the retracting shaft having a gripper portion on the end thereof for contacting the valve core; and the gripper portion having a longitudinal slot to receive the valve core.

2. A valve core gripper device capable of gripping a valve core, in order to insert or remove a valve core from a housing of a tire valve or a refrigerant system, comprising:

the valve core gripper device having a gripper housing;

the gripper housing having a gripper end oppositely disposed from a removal end;

a grasping collet being extendible from or retractable into the removal end;

the grasping collet being attachable to or removable from a valve core;

the gripper housing including a retractor spring;

the retractor spring cooperating with the grasping collet for extending or retracting thereof;

the grasping collet permitting removal or insertion of the valve core as desired;

the valve core gripper including a retractor assembly;

the retractor assembly including, the gripper housing and a grasping surface on the outside of the gripper housing;

at least one set screw supporting the retractor spring;

at least one O-ring supporting pressure in the gripper housing to hold the valve core as desired;

a push button operating the tire valve core wrench;

the grasping surface including a knurled grip on the gripper housing;

the removal end having the grasping collet with a gripper canal and a wrench slot;

the removal end serving a removal function and an insertion function;

the pushbutton having a twist control in to move an extractor to or from the valve core;

the extractor serving as the removal end or the gripper end for the valve core;

the valve core gripper device including an extender to contact the valve core;

the pushbutton and the twist control controlling the extender;

the twist control cooperating with the extender;

the extender being positioned on an end of the valve core gripper device for inserting or removing the valve core;

a retracting shaft extending from a retaining collar in the gripper housing for the valve core wrench;

the retracting shaft having a gripper portion on the end thereof for contacting the valve core; and the gripper portion having a longitudinal slot to receive the valve core.

3. The valve core gripper of claim 1 or claim 2, further comprising:

the retractor spring fitting over the retracting shaft and being positioned within a housing body;

a taper adjustment shaft within the housing body contacting the retaining collar;

the retaining collar positioned interior of the housing body;

the housing body storing the retracting shaft, the gripper portion and the longitudinal slot therewithin;

the knurled grip being positioned on an exterior of the housing body to provide control of the tire valve core wrench;

a threaded aperture being positioned above the knurled grip;

an adjustment screw in the threaded aperture holding the retractor spring in position;

the housing body exposing the wrench slot to twist the valve core;

the grasping collet having the gripper canal for the wrench slot to receive the valve core;

the knurled grip on the housing body providing a movement for the valve core of the tire valve; and the pushbutton having the ring aperture therein.

4. The valve core gripper of claim 3 further comprising:

the key ring fitting through the ring aperture in the push button;

the push button leading to the taper adjustment shaft;

the taper adjustment shaft leading to the retaining collar;

a travel stop including a taper on the push button;

the push button cooperating with the set screw to limit the travel of the push button;

the knurled grip being positioned adjacent to a slide adapter;

the slide adapter being within the housing body;

an inner O-ring and an outer O-ring being positioned on the adapter for sealing purposes;

clockwise female threads being positioned on an end of an extractor housing tube to receive threaded bushing;

counterclockwise male threads on an end of oppositely disposed from the threaded bushing end;

the extractor fitting within the extractor housing tube;

the extractor having a screw flat and the longitudinal slot; and the longitudinal slot being oppositely disposed from the screw flat; and the push button cooperating with the set screw to limit the retractor spring pressure being applied to the valve core.

5. The valve core gripper of claim 4, further comprising:

the housing body including storage area;

the slide aperture in a coupling collar receiving the extractor housing tube;

the knurled grip facilitating use of the coupling collar;

a second O-ring and a third O-ring supporting the seal collar within the coupling collar;

a first O-ring also supporting the seal collar against threads within coupling collar; and the valve core gripper device being formed of metal, plastic, composite material or combinations thereof.

6. The valve core gripper device of claim 2 further comprising:

a) the valve core gripper device being applied to a refrigeration valve core as a refrigeration valve core puller;

b) the gripper housing supporting the refrigeration valve core puller;

c) an extractor button being at one end of the gripper housing;

d) the extractor button contacting a retractor spring within the gripper housing;

e) the gripper housing including a knurled grip on an exterior thereof;

f) the retractor spring being mounted within the gripper housing between the knurled grip and the extractor button;

g) the retractor spring facilitating an operation of the refrigeration valve core puller;

h) a slide adapter on the gripper housing extending below the knurled grip;

i) an extractor housing tube extending from the knurled grip through the slide adapter and terminating at an extractor tip; and j) the extractor tip serving as a removal end or an insertion end for valve core.

7. The valve core gripper device of claim 2 further comprising:

the valve core gripper device being applied to a high-pressure valve core remover;

the gripper housing supporting the high-pressure valve core remover;

the gripper housing having a safety relief adapter positioned thereover;

the gripper housing and the safety relief adapter cooperating to complete the high-pressure valve core remover;

an extractor button being mounted at one end of the housing for the high-pressure valve core remover;

the extractor button operating a retractor spring;

the retractor spring being positioned on a retracting shaft adjacent to the extractor button;

a retaining collar on the retracting shaft holding a knurled grip in a desired position;

a slide aperture in the safety relief adapter receiving the retracting shaft;

the retracting shaft serving as a remover end or an insertion end for a valve core;

a plurality of exhaust vents being in the safety relief adapter; and female coupling threads being oppositely disposed from the extractor button for attachment to a high pressure valve on a high pressure tire.

* * * * *